US005197554A

United States Patent [19]

Zijsling

[11] Patent Number: 5,197,554

[45] Date of Patent: Mar. 30, 1993

[54] ROTARY DRILL BIT FOR DRILLING THROUGH STICKY FORMATIONS

[75] Inventor: Djurre H. Zijsling, Assen, Netherlands

[73] Assignee: Shell Internationale Research Maatschappij B.V. The Netherlands, The Hague, Netherlands

[21] Appl. No.: 422,885

[22] Filed: Oct. 19, 1989

[30] Foreign Application Priority Data

Oct. 20, 1988 [GB] United Kingdom ..... 8824546

[51] Int. Cl.[5] ..... E21B 10/60

[52] U.S. Cl. ..... 175/393; 175/431

[58] Field of Search ..... 175/329, 339, 340, 393, 175/397, 400, 421; 299/81

[56] References Cited

U.S. PATENT DOCUMENTS 2,371,489 3/1945 Williams Jr. ..... 175/329
3,215,215 11/1965 Kellner ..... 175/393 X
4,554,986 11/1985 Jones ..... 175/329 X
4,655,303 4/1987 Winters et al. ..... 175/393 X
4,696,354 9/1987 King et al. ..... 175/393 X

*Primary Examiner*—David J. Bagnell
*Attorney, Agent, or Firm*—Jones, Tullar & Cooper

[57] ABSTRACT

A drill bit for drilling through sticky formations, such as chalk or marl, comprises a plurality of waterways for transporting drilling fluid and rock flour to the gauge of the bit. These waterways have in downstream direction gradually increasing cross-sectional areas A, the increase of size of said areas along the length of a waterway being at least substantially proportional to the squared radius r thereof from the central axis. In this manner the rock flour velocity remains equal or decreases in downstream direction in the waterways so that the risk of rock flour accumulation and compaction is reduced.

5 Claims, 1 Drawing Sheet

ROTARY DRILL BIT FOR DRILLING THROUGH STICKY FORMATIONS

The invention relates to a rotary drill bit for drilling through sticky formations.

It is known that during drilling through sticky formations, such as chalk or marl, the rock flour produced has a strong tendency to stick to the bit face. For drilling through such sticky formations generally fishtail bits are used, which bits have wide waterways between the cutting wings.

Field experience has taught that in spite of the presence of wide waterways it frequently occurs that rock flour accumulates in front of the cutting wings leaving only small channels open to allow drilling fluid to flow from the nozzles to the gauge of the bit. Occasionally it has occurred that the motion of the accumulated rock flour through the waterways was hampered and that the rock flour was compacted in the waterways and started to carry the majority of the weight on the bit, thereby resulting in a completely balled-up bit and poor drilling performance.

The purpose of the present invention is to provide a rotary drill bit wherein the occurrence of rock flour compaction in the waterways is avoided.

The rotary drill bit according to the invention comprises:

- a bit body on which a plurality of cutting wings are mounted, the wings extending along the bit body from a central axis of the bit towards the gauge of the bit, and
- a plurality of waterways for transporting drilling fluid and rock flour to the gauge of the bit, each waterway being formed between a pair of adjacent wings and having at each point along its length a cross-sectional area A measured in a plane perpendicular to a central chord of the waterway, wherein the size of the cross-sectional areas A increase in a direction from the central axis towards the gauge of the bit in such a manner that the increase in size of the areas in the direction from the central axis toward the gauge is at least substantially proportional to the squared radius r of the areas from the central axis, the radius r of a particular area A being defined as the average distance between the central axis and the locations where the plane in which said particular area A is measured crosses the tips of the adjacent cutting wings.

The bit according to the invention is designed such that the average velocity of the rock flour in the waterways remains constant or decreases continuously in a direction from the bit centre towards the gauge of the bit thereby providing mechanical cleaning in case the hydraulic cleaning is no longer adequate.

A specific embodiment of the bit according to the invention will be described by way of example with reference to the accompanying drawings in which.

Figure 2:
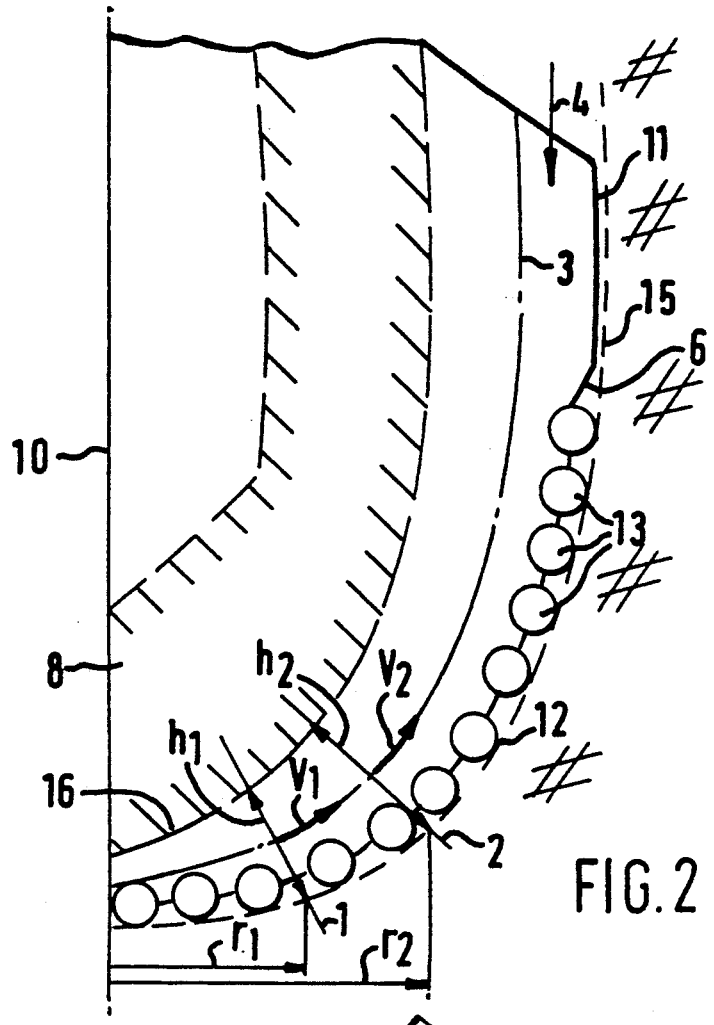
FIG. 2 is a sectional view of the bit of FIG. 1, taken along line II—II and seen in the direction of the arrows.
Figure 1:
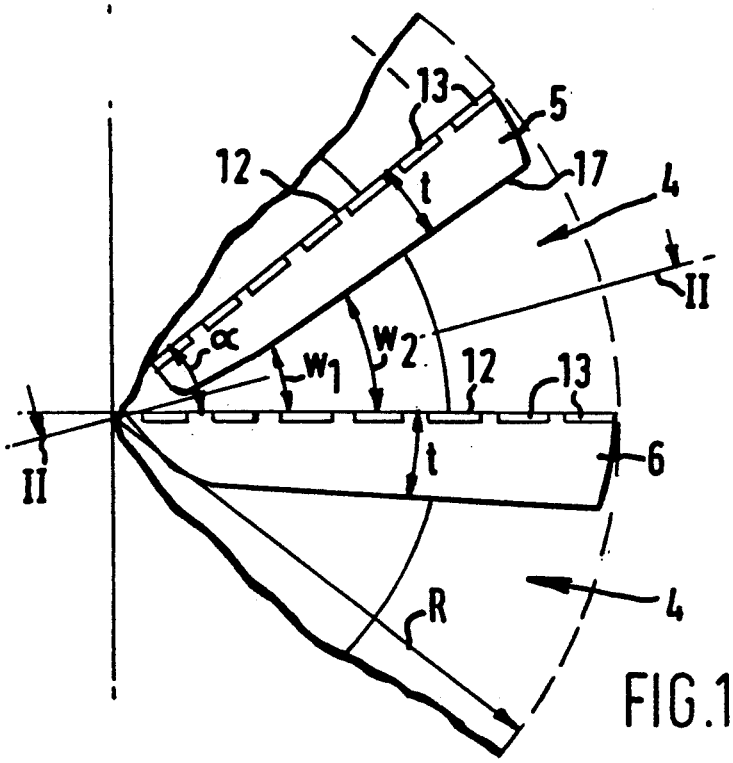
FIG. 1 is a bottom view of a section of a bit according to the invention.

FIGS. 1 and 2 show a bit according to the invention. FIG. 2 furthermore shows a first plane 1 and a second plane 2. The planes 1 and 2 are each oriented perpendicular to a central chord 3 of a waterway 4 formed between a pair of adjacent cutting wings 5 and 6 of the bit.

The bit has eight regularly distributed cutting wings, two of which are shown in FIG. 1. The cutting wings 5 and 6 extend along the bit body 8 from the central axis 10 of the bit towards the gauge 11 of the bit. The cutting wings 5 and 6 have a substantially radial orientation relative to the central axis 10 and they are equipped near their tips 12 with a series of disc-shaped polycrystalline diamond compact (PDC) cutters 13.

The waterways 4 are each formed between the hole bottom 15, the bit face 16, the front side of one cutting wing 6 and the back side 17 of another cutting wing 5.

The central chord of each waterway 4 is formed by the centre of the fluid passage provided by the waterway so that each point of the chord 3 is located at equal distances from the front side of one cutting wing 6 and the back side 17 of another cutting wing 5 and also at equal distances from the hole bottom 15 and the bit face 16.

In view of the rectangular shape of the waterways the cross-sectional area of the waterway 4 can be defined as:

$$A = W \cdot h. \tag{1}$$

h being the height of the waterway 4 defined as the distance between the bit face 16 and the tips 12 of the wings, the distance being measured in a plane perpendicular to the central chord 3, and w being the width of the waterway 4 defined as the distance between the front side of one cutting wing 6 and the back side 17 of another cutting wing, the distance being measured in a plane perpendicular to the central chord 3.

As can be seen in FIGS. 1 and 2 the cross-sectional area A, of the waterway 4 in the first plane 1 is defined by $A_1 = w_1 \cdot h_1$, whereas the cross-sectional area $A_2$ of the waterway 4 in said second plane 2 is defined by $A_2 = w_2 \cdot h_2$.

In the bit according to the invention the size of the cross-sectional areas A of the waterways 4 increases in a direction from the central axis 10 towards the gauge 11 of the bit in such a manner that the increase in size of the areas A in said direction from the central axis 10 towards the gauge 11 of the bit is at least substantially proportional to the squared radius r of a particular area A from the central axis 10. The radius r of a specific area A is defined as the average distance between the central axis 10 and the locations where a plane in which the area A is measured crosses the tips 12 of adjacent cutting wings 5, 6.

The implication of the bit design according to the invention to the cross-sectional areas $A_1$, and $A_2$ of the first and second plane 1 and 2 shown in FIG. 2 is that the ratio between the areas $A_1$ and $A_2$ fulfills the equation:

$$A_2 \geqq A_1 \cdot (r_2/r_1)^2, \tag{2}$$

$r_1$ being the average radius at which plane 1 crosses the tips 12 of adjacent cutting wings 5, 6, the radius being measured from the central axis 10, $r_2$ being the average radius at which plane 2 crosses the tips 12 of adjacent cutting wings 5, 6, the radius being measured from the central axis, and $r_2$ being larger than $r_1$.

In the embodiment of the invention shown in the drawing the cutting wings 5 and 6 have a radial orientation relative to the central axis. In this embodiment plane 1 intersects the tips 12 of the adjacent wings 5 and 6 at about equal distances from the central axis 10, and the same applies to the intersection between plane 2 and the tips. Therefore plane 1 intersects the tips 12 at a radius $r_1$ whereas plane 2 also intersects the tips 12 at a radius $r_2$. In an alternative embodiment of the invention, however, the cutting wings may have a spiralling orientation relative to the central axis. Then a plane cross-axial to a central chord of a waterway will intersect the tips of adjacent wings of different radii, the average of which radii must be taken into account for defining the ratio between the cross-sectional areas $A_1$ and $A_2$.

As in the embodiment shown in the drawing each waterway furthermore has a substantially rectangular cross-sectional area A and the thickness of the cutting wings 5 and 6 is small in comparison to the width w of the waterways 4 the ratio between the width $W_2$ and the width $W_1$ of the waterways in the planes 1 and 2 can be estimated by:

$$W_1/W_2 = r_1 \sin \alpha / r_2 \sin \alpha \quad (3)$$

$\alpha$ being the angle between adjacent cutting wings.

Combinations of equations (2) and (3) gives:

$$h_2 \geqq h_1 \cdot (r_2/r_1) \quad (4)$$

Accordingly in the embodiment shown where the bit has radial cutting wings and rectangular waterways the height h of each waterway will increase in the radial direction away from the central axis such that the variation of the height h is at least substantially proportional to the increase of the radius r at which the plane in which the height h is measured intersects the tips 12 of adjacent cutting wings 5 and 6.

The bit design according to the invention is based on the insight that the velocity of the rock flour should not increase along its flow path through each waterway. An increase of rock flour velocity is an indication of a relative decrease of the cross-sectional area of the waterway in comparison to the rock flour volume V passing therethrough. Accordingly an increased rock flour velocity along the flow path might lead to rock flour compaction and thus to plugging of the waterway. To avoid rock flour compaction under all circumstances it is preferred to design the waterways such that the rock flour velocity gradually decreases in the downstream direction through the waterways.

The bit design according to the invention is furthermore based on the insight that the volume V of rock flour that passes through the water ways at the gauge 11 of the bit during one full revolution of the bit equals the volume of a cylinder of rock which is removed from the earth crust during the revolution. This volume can be expressed as:

$$V = n.R^2.ROP \quad (5)$$

V is the rock flour volume removed by the bit, R is the outer radius of the cutting tips 12, and ROP is the rate of penetration at which the borehole is deepened during one full revolution of the bit.

In the bit shown in the drawing this rock flour volume V is passed through eight waterways. Accordingly the rock flour volume V' passing through one waterway during one revolution of the bit equals: $V' = \frac{1}{8}.n.R^2.ROP$.

The rock flour volume V', that passes through the cross-sectional area A, during a revolution of the bit of the waterway equals $\frac{1}{8}$ of the volume of the cylinder of rock removed from the earth crust within a radius $r_1$ during the revolution, or:

$$V_1' = \tfrac{1}{8}.n.R_1^2.ROP$$

Following the same line of reasoning for the rock flour volume $V_2'$ passing through cross-sectional area $A_2$ gives:

$$V_2' = \tfrac{1}{8}.n.r_2^2.ROP$$

Introduction of the rock flour velocity v in a waterway as the ratio between the rock flour volume V passing at a certain cross-sectional area A through the waterway and the size of the cross-sectional area A gives for the velocities $v_1$ and $v_2$ in the planes 1 and 2:

$$n \cdot r_1^2 \cdot ROP/8 \cdot A_1;$$

$$n \cdot r_2^2 \cdot ROP/8 \cdot A_2; \quad (6)$$

Taking now into account that the rock flour velocity should not increase in the downstream direction along the flow path of each waterway, or in other words, the velocity should remain constant or decrease in the downstream direction gives:

$$v_2 \geqq v_1 \quad (7)$$

combination of equations (6) and (7) gives:

$$r_2^2/A_2 \geqq r_1^2/A_1, \text{ or } A_2/A_1 \geqq r_2^2/r_1^2 \quad (8)$$

Equation (8) equals equation (2) and equations (2) and (8) are based on the principle that the rock flour velocity v should decrease or at least remain equal in the downstream direction of each waterway. In this manner accumulation and compaction of rock flour in the waterways is avoided and mechanical cleaning of the waterways is accomplished. The mechanical cleaning capability is of importance if the hydraulic cleaning provided by the flow of drilling fluid is no longer adequate.

The bit concept according to the invention can be used in a fishtail bit or in any other bit in which waterways are formed between cutting wings. The bit body may be dome-shaped and the cutting wings of the bit may have a radial or a spiralling orientation relative to a central axis of the bit body. Accordingly it is to be clearly understood that the embodiment shown in the drawing is illustrative only.

I claim:

1. A rotary bit for drilling through sticky formations, the bit comprising:

a bit body on which a plurality of cutting wings are mounted, said wings extending along the bit body from a central axis of the bit towards the gauge of the bit, and a plurality of waterways for transporting drilling fluid and rock flour to the gauge of the bit, each waterway being formed between a pair of adjacent wings and having at each point along its length a cross-sectional area A measured in a plane perpendicular to the central chord of the waterway, wherein a cross-sectional area $A_2$ of the waterway in a second plane and a cross-sectional area $A_1$ of the same waterway in a first plane satisfy the relation: $A_2 \geqq A_1(r_2/r_1)^2$, where $r_1$ is the average radius at which said first plane crosses the tips of adjacent cutting wings, said radius being measured from the central axis of the bit, $r_2$ is the average radius at which said second plane crosses the tips of adjacent cutting wings, said radius being measured from the central axis of the bit, and $r_2$ is larger than $r_1$.

2. The bit of claim 1, wherein the cutting wings have a substantially radial orientation relative to the central axis of the bit and each waterway has at each point along its length a substantially rectangular cross-sectional area A and wherein the ratio between the height $h_1$ of the cross-sectional area $A_1$ of the waterway in said first plane and the height $h_2$ of the cross-sectional area $A_2$ of the waterway in said second plane satisfies the relation: $h_2 \geqq h_1(r_2/r_1)$, where $h_1$ is the height of area $A_1$ as defined by the distance between the tip of an adjacent cutting wing and the bit body when measured in said first plane, and $h_2$ is the height of area $A_2$ as defined by the distance between the tip of an adjacent cutting wing and the bit body when measured in said second plane.

3. The bit of claim 1 or 2, wherein the cutting wings are equipped near their tips with a series of disc-shaped polycrystalline diamond compact cutters.

4. The bit of claim 3, wherein the bit has a dome-shaped bit body on which the plurality of cutting wings are mounted at equally distributed angular intervals.

5. The bit of claim 1 or 2, wherein the bit has a dome-shaped bit body on which the plurality of cutting wings are mounted at equally distributed angular intervals.

* * * * *